US008000078B2

(12) United States Patent
Maraval

(10) Patent No.: US 8,000,078 B2
(45) **Date of Patent: *Aug. 16, 2011**

(54) METHOD AND APPARATUS FOR CONTROLLING A LIFTING MAGNET SUPPLIED WITH AN AC SOURCE

(75) Inventor: Jean Maraval, Columbia, SC (US)

(73) Assignee: The Electric Controller & Manufacturing Company, LLC, St. Matthews, SC (US)

( * ) Notice: Subject to any disclaimer, the term of this patent is extended or adjusted under 35 U.S.C. 154(b) by 340 days.

This patent is subject to a terminal disclaimer.

(21) Appl. No.: 12/040,741

(22) Filed: Feb. 29, 2008

(65) Prior Publication Data

US 2009/0161284 A1 Jun. 25, 2009

Related U.S. Application Data

(60) Provisional application No. 61/066,121, filed on Dec. 19, 2007.

(51) Int. Cl.
*H01H 47/00* (2006.01)

(52) U.S. Cl. ..... 361/144; 361/143; 361/152

(58) Field of Classification Search ..... 361/144
See application file for complete search history.

(56) References Cited

U.S. PATENT DOCUMENTS 3,445,105 A 5/1969 Marcher
3,859,571 A 1/1975 Strobl et al.
5,813,712 A * 9/1998 Mozelt ..... 294/65.5
5,875,281 A 2/1999 Thexton et al.
5,905,624 A * 5/1999 Andreica et al. ..... 361/144
6,088,210 A 7/2000 Goodman
6,710,574 B2 3/2004 Davis et al.
(Continued)

FOREIGN PATENT DOCUMENTS

CN 2920948 Y 7/2007
(Continued)

OTHER PUBLICATIONS

Fukada Takafumi, Method and apparatus for controlling voltage of lifting mgnet, Publication date: Dec. 13, 2002, par. 0004 and drawing 4.*

(Continued)

*Primary Examiner* — Dharti H Patel
(74) *Attorney, Agent, or Firm* — Knobbe, Martens, Olson & Bear, LLP

(57) ABSTRACT

A magnet controller supplied by an AC source controls a lifting magnet. Two bridges allow DC current to flow in both directions in the lifting magnet. During "Lift", relatively high voltage is applied to the lifting magnet until it reaches its cold current. Then voltage is lowered. After a desired interval, once the magnet has had time to build its electromagnetic field, voltage is further reduced to prevent the magnet from overheating. The magnet lifting forced is maintained due to the magnetic circuit hysteresis. During "Drop", reverse voltage is applied briefly to demagnetize the lifting magnet. At the end of the "Lift" and the "Drop", most of the lifting magnet energy is returned to the line source. A logic controller controls current and voltage of the magnet and calculates the magnet's temperature. In one embodiment, a "Sweep" switch is provided to allow reduction of the magnet power to prevent attraction to the bottom or walls of magnetic rail cars or containers.

11 Claims, 13 Drawing Sheets

U.S. PATENT DOCUMENTS

| | | | | |
|---|---|---|---|---|
| 7,461,569 | B2 * | 12/2008 | Bianchi | 74/335 |
| 7,495,879 | B2 | 2/2009 | Thexton et al. | |
| 7,697,253 | B1 | 4/2010 | Maraval | |
| 2005/0094345 | A1 | 5/2005 | Pollock et al. | |
| 2008/0143260 | A1 * | 6/2008 | Tuymer et al. | 315/111.21 |
| 2009/0160590 | A1 | 6/2009 | Maraval et al. | |

FOREIGN PATENT DOCUMENTS

| | | | |
|---|---|---|---|
| DE | 2610781 | A1 | 9/1977 |
| JP | 05343222 | A | 12/1993 |
| JP | 09142770 | A | 6/1997 |
| JP | 2002359112 | A | 12/2002 |
| JP | 2004299821 | A | 10/2004 |
| WO | WO 2009/086171 | | 7/2009 |

OTHER PUBLICATIONS

International Search Report from PCT/US2008/087785, Apr. 6, 2009, 5 pages.

Notice of Allowance dated Dec. 2, 2009 from Related U.S. Appl. No. 11/757,304.

* cited by examiner

DC Equivalent Circuit

Main SFC

Ready SFC

Lift SFC

Hold SFC

Drop SFC

DC Regulated Power Supply Voltage Selection

DC Regulated Power Supply Current Selection

METHOD AND APPARATUS FOR CONTROLLING A LIFTING MAGNET SUPPLIED WITH AN AC SOURCE

REFERENCE TO RELATED APPLICATIONS

The present application claims priority from U.S. Provisional Application No. 61/066,121, filed Dec. 19, 2007, titled "METHOD FOR CONTROLLING A LIFTING MAGNET SUPPLIED WITH AN AC SOURCE," the entire contents of which is hereby incorporated by reference.

BACKGROUND

1. Field of the Invention

The present invention relates to a method and apparatus for controlling a lifting magnet of a materials handling machine for which the source of electrical power is an AC power source.

2. Prior Art

Lifting magnets are commonly attached to hoists to load, unload, and otherwise move scrap steel and other ferrous metals. For many years, cranes were designed to be powered by DC sources, and therefore systems used to control lifting magnets were designed to be powered by DC as well. When using a hoist, due to the nature of the overhauling load, the torque and speed of the hoist motor need to be controlled. The traditional approach was to control the DC motor torque and speed by selecting resistors in series with the DC motor field and armature windings by means of contactors. In recent years, with the advance of electronic technology in the field of motor control, systems used to control lifting magnets, namely cranes, are now designed to be powered by AC sources. Cranes are now equipped with adjustable-frequency drives, commonly referred to as AC drives, which can accurately control the speed and torque of AC induction motors. The use of AC supplies removes the costs of installing and maintaining large AC-to-DC rectifiers, of replacing DC contactor tips, and of maintaining DC motor brushes and collectors. However, in order to use a lifting magnet on one of the new AC supplied cranes, a rectifier needs to be added to the crane. The rectifier that needs to be added to the crane is generally composed of a three-phase voltage step-down transformer connected to a six-diode bridge rectifier. The rectifier that is added to the crane is either mounted on the crane itself, where the rectifier becomes a weight constraint and an obstruction, or the rectifier is mounted elsewhere in the plant, in which case additional hot rails are required along the bridge and trolley in order for the DC electrical power to reach the DC-supplied magnet controller.

While lifting magnets have been in common use for many years, the systems used to control these lifting magnets remain relatively primitive. During the "Lift", a DC current energizes the lifting magnet in order to attract and retain the magnetic materials to be displaced. When the materials need to be separated from the lifting magnet, most of the controllers automatically apply a reversed voltage across the lifting magnet for a short period of time to allow the consequently reversed current to reach a fraction of the "Lift" current. The phase during which there is a reversed voltage applied across the magnet is known as the "Drop" phase, during which a magnetic field in the lifting magnet of the same magnitude but in an opposite direction of the residual magnetic field is produced such that the two fields cancel each other. When the lifting magnet is free of residual magnetic field, the scrap metal detaches freely from the lifting magnet. This metal detachment is known as a "Clean Drop".

Some control systems operate to selectively open and close contacts that, when closed, complete a "Lift" or "Drop" circuit between the DC generator and the lifting magnet. At the end of the "Lift", which is called the "discharge" and at the end of the "Drop", which is called the "secondary discharge", these systems generally use either a resistor or a varistor to discharge the lifting magnet's energy. The higher the resistor's resistance value or varistor breakdown voltage, the faster the lifting magnet discharges, but also the higher the voltage spike across the lifting magnet. High voltage spikes cause arcing between the contacts. In addition, fast rising voltage spikes also eventually wear out the lifting magnet insulation, and the insulation of the cables connecting the lifting magnet to the controller. To withstand these voltage spikes, generally in the magnitude of 750 V DC with systems using DC magnets rated at 240 V DC, the lifting magnet, cables, and the control system contacts and other components need to be constructed of more expensive materials, and also need to be made larger in size.

Lifting magnets are rated by their cold current (current through the magnet under rated voltage, typically 250V DC, when the magnet temperature is 25° C.). These lifting magnets are designed for a 75% duty cycle (in a 10 minute period the magnet can have voltage applied at 250V DC for 7 minutes 30 seconds and the remaining 2 minutes 30 seconds the magnet must be off for cooling or the magnet will overheat). Today, magnet control systems are limited by the rectified DC voltage supplying the magnet control (typically 250-350V DC). These systems control the voltage to the magnet and as the magnet heats up, the resistance rises and the current drops. As a magnet heats up, the magnet loses 25-35% in lifting capacity because the resistance of the wire increases and the current through the lifting magnet decreases.

SUMMARY

These and other problems are solved by a new and improved method and apparatus for controlling a lifting magnet using an AC source, described here.

In one embodiment, the voltage and the current are controlled during the charging of the lifting magnet during the lift cycle. Charging involves the phase that begins the "Lift" mode during which the current in the lifting magnet increases. Voltage levels up to 500V DC or more are applied to the lifting magnet during the charge. When a current value related to the cold current rating of the lifting magnet is reached, then the current is limited to this value until the end of the "Lift" mode. The lifting magnet can overheat if the current is maintained at the cold current level or higher, so after a preset time, during which the material attaches to the lifting magnet, the voltage on the lifting magnet is reduced to a holding voltage which causes a relatively lower current than the current applied during the "Lift" of the lifting magnet. The period during which there is a holding voltage applied to the lifting magnet is the "Hold" mode and this "Hold" mode allows the lifting magnet to hold the material that the lifting magnet has already picked-up.

In one embodiment, the "Lift" mode is initiated by the operator. During the "Lift" mode, a first voltage is applied across the lifting magnet. Then, the operator can select a relatively higher voltage continue to be applied to the magnet in order to secure a load that has been picked up by the magnet.

In one embodiment, the voltage levels during "Lift" and "Hold" modes are user-selectable.

In one embodiment, the ratio of "Lift" to "Hold" voltages is user-selectable, based on the type of application sought.

In one embodiment, the magnetic field is maintained in the lifting magnet from the magnet's cold state to the magnet's hot state during the charging of the lifting magnet. Since the lifting magnet's field is primarily controlled by NI (where N=turns of wire and I=current), maintaining the same current for a cold or hot magnet maintains substantially the same magnetic field.

In one embodiment, most of the lifting magnet energy used during the "Lift" and the "Drop" phases is returned to the line source rather than being dissipated in resistors, varistors, or other lossy elements.

In one embodiment, if during "Lift" or "Drop", the controller is accidentally disconnected from the line such that the current cannot keep flowing in the lifting magnet, the voltage across the lifting magnet sharply rises and consequently this fast voltage rise turns one or more voltage protection devices before their breakover voltage is attained. In addition, the lifting magnet controller circuitry can be protected by the use of circuit breakers, such as, for example, a high speed breaker.

In one embodiment, switching of current for the lifting magnet is provided by solid-state devices.

In one embodiment, the control system is configured to increase the useful life of the lifting magnet by reducing voltage spikes in the lifting magnet circuit. During operation, the instantaneous voltage across the magnet typically should not exceed the line voltage, i.e. for a system rated 460 V AC RMS, peak voltage is $460\times\sqrt{2}=650$ V, whereas voltages in prior art systems typically exceed 750 V.

In one embodiment, the control system is configured to increase the useful life of the lifting magnet, by providing a "Hold" mode that reduces magnet heating.

In one embodiment, the control system is configured to save energy by providing a "Hold" mode that reduces energy consumption.

In one embodiment, the control system is configured to reduce the "Lift" time. A shorter "Lift" time helps to increase production by reducing the lifting magnet cycle times. Using a higher AC voltage can provide relatively shorter "Lift" times. Some existing systems use a step-down voltage transformer which reduces the maximum voltage that can be applied to the magnet during "Lift", and therefore these systems could not lift as quickly as systems with full line AC voltages.

In one embodiment, the control system is configured to reduce the "Drop" time. A shorter "Drop" time helps to increase production by reducing the lifting magnet cycle times. Some existing systems use a resistor, which causes voltage to decay with the current, leading to longer discharge times. Using a constant voltage source to discharge the lifting magnet energy allows a faster discharge.

In one embodiment, the control system is configured to monitor the lifting magnet resistance. Using the direct relationship between the magnet resistance and the magnet's winding temperature, resistance values corresponding to different meaningful temperature levels of the lifting magnet can be monitored.

In one embodiment, the control system is configured to indicate an alarm to the operator if the lifting magnet temperature rises above a threshold level.

In one embodiment, the control system is configured to protect and increase the useful life of the lifting magnet by providing a "Trip" mode, which, based on an indication of the lifting magnet's temperature, determines whether the system should directly enter "Drop" mode instead of "Lift" mode, to reduce magnet heating.

In one embodiment, the control system is configured to prevent the lifting magnet from sticking to the bottom and walls of magnetizable containers by providing a "Sweep" mode that reduces the voltage levels applied to the lifting magnet during the "Lift" and "Hold" modes.

DETAILED DESCRIPTION

Figure 1:
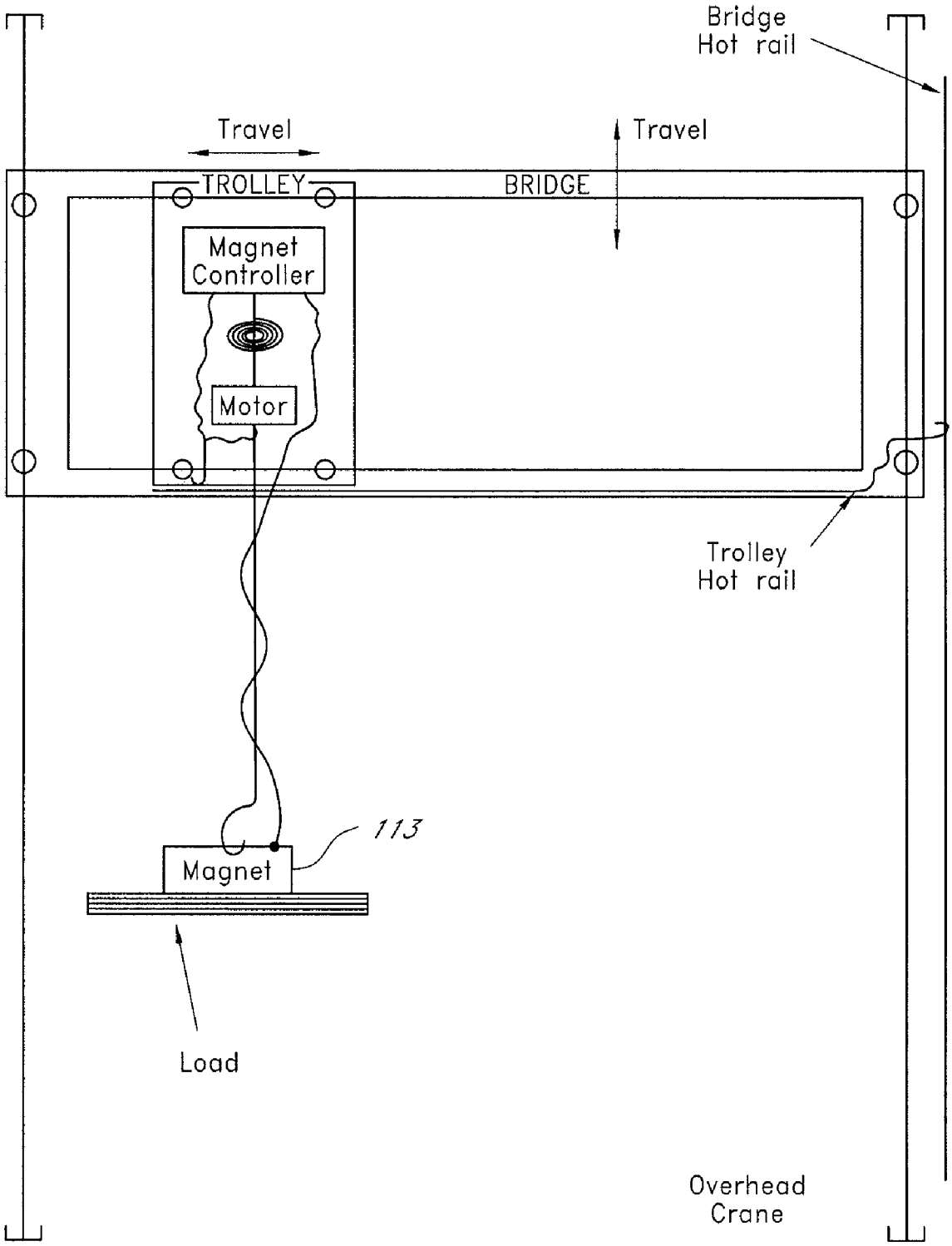
FIG. 1 shows an overhead crane with lifting magnet.

FIG. 1 shows an overhead crane with lifting magnet 113. The lifting magnet 113 is attached by cables to the magnet controller which controls the lifting magnet 113 from the bridge of the overhead bridge crane.

FIG. 2 shows a lifting magnet controller circuit that includes a Logic Controller (LC) 100. In one embodiment, the LC 100 can be a Programmable Logic Controller (PLC). The LC 100 receives input commands from an operator and provides alarm and trip relay outputs. Outputs from the logic controller 100 are provided to respective switches 101-112. The switches 101-103 and 110-112 are configured in a positive bridge 250 to provide current to the lifting magnet 113 in a first direction, and switches 104-109 are configured in a negative bridge 251 to provide current to the lifting magnet 113 in a second direction. The switches 101-112 can be any type of mechanical or solid-state switch device so long as the devices are capable of switching at a desired speed and can withstand voltage spikes. For convenience, and not by way of limitation, FIG. 2 shows the switches 101-112 as thyristors, each having an anode, a cathode and a gate. One of ordinary skill in the art will recognize that the switches 101-112 can be bipolar transistors, insulated gate bipolar transistors, field-effect transistors, MOSFETs, etc. One of ordinary skill in the art will also recognize that the number of switches used can be less or more than the twelve shown; using a greater number of switches reduces ripple.

Figure 2A:
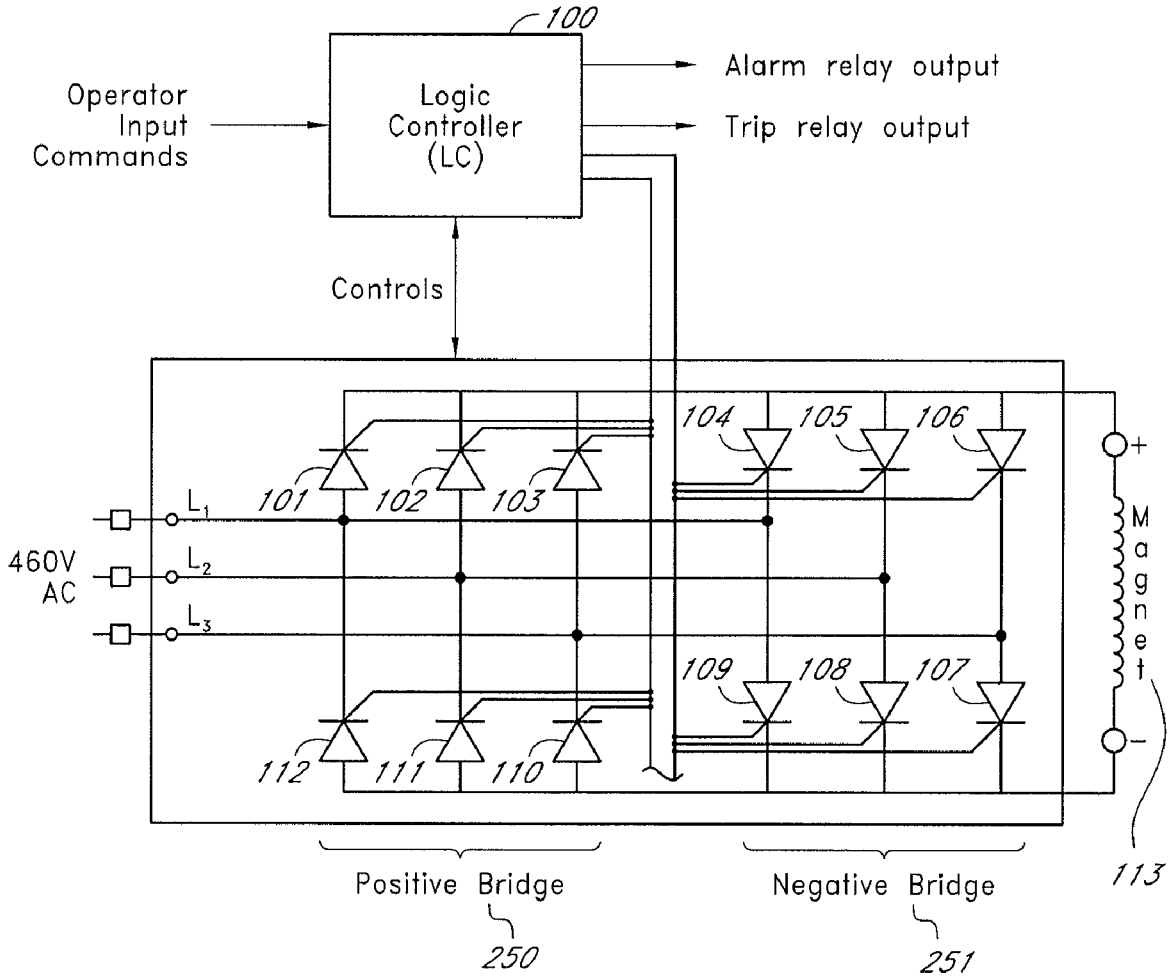
FIG. 2A shows an AC lifting magnet system.
Figure 2B:
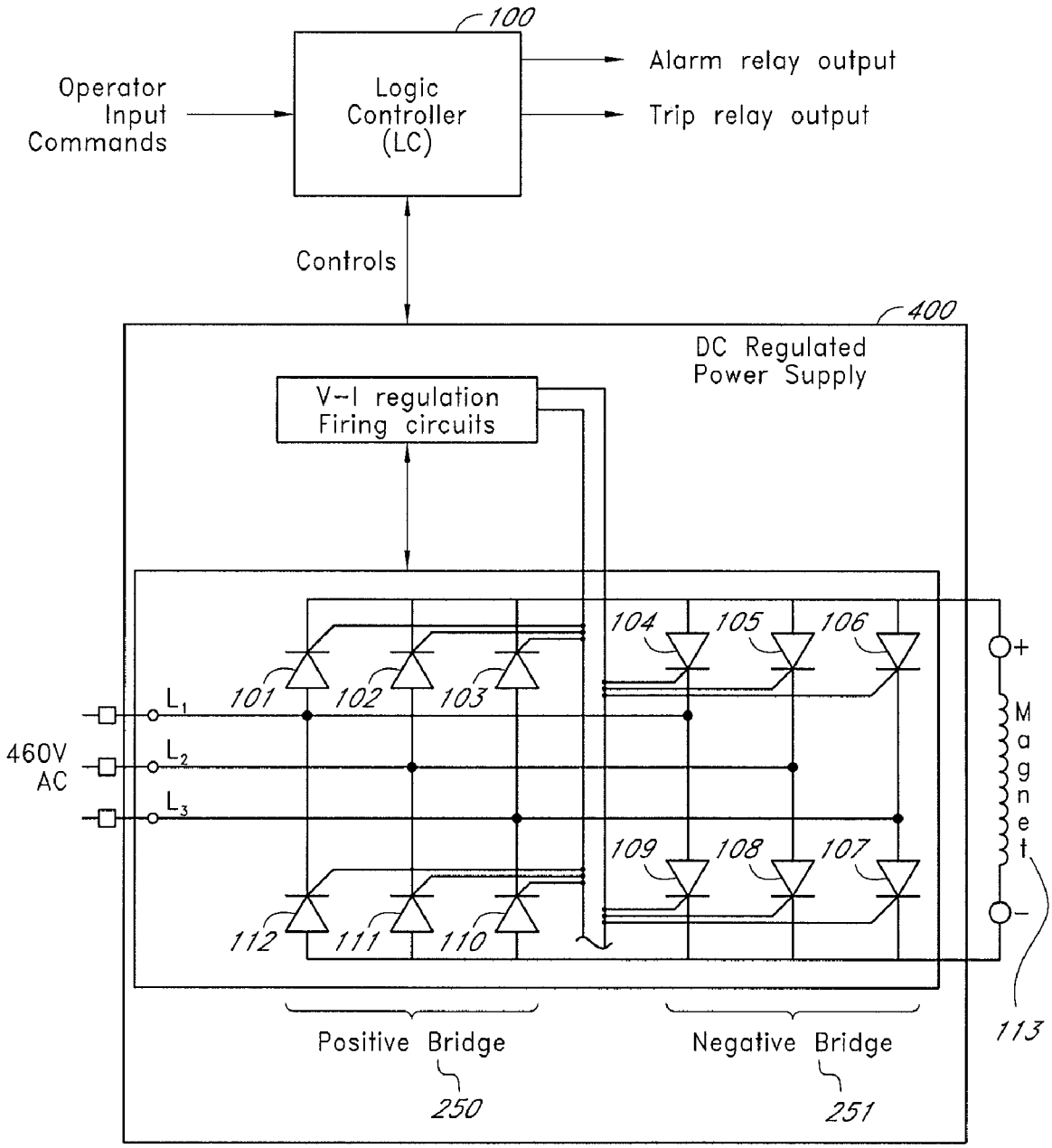
FIG. 2B shows an AC lifting magnet system with an optional DC Power Converter such as a DC Regulated Power Supply.

FIG. 2A shows the lifting magnet controller. FIG. 2B shows one embodiment of the lifting magnet controller where a DC Power Converter such as a DC Regulated Power Supply 400 is used. The DC Regulated Power Supply 400 is one embodiment of a DC Power Converter, and is used as an example and not by way of limitation.

In FIGS. 2A and 2B, the thyristors 101-112 will initially conduct when the anode is positive with respect to the cathode and a positive gate current or gate pulse is present. The gate current can be removed once the thyristor has switched on. The thyristors 101-112 will continue to conduct as long as the respective anode remains sufficiently positive with respect to the respective cathode to allow sufficient holding current to flow. The thyristors 101-112 will switch off when the respective anode is no longer positive with respect to the respective cathode. The amount of rectified DC voltage can be controlled by timing the input to the respective gate. Applying current on the gate without delay to the natural commutation time will result in a higher average voltage applied to the lifting magnet 113 (where natural commutation time is understood in the art to be the time at which the SCRs would start conducting if they were replaced by diodes). Applying current on the gate later will result in a lower average voltage applied to the lifting magnet 113. When the current in the magnet needs to be turned off, the application of the current on the gate can be further delayed to the point where voltage across the magnet 113 reverses, restoring the magnet energy to the AC supply. The period of time which precedes the "Drop" mode is called discharge. Six thyristors, 101-103 and 110-112, are connected together to make a three-phase bridge rectifier 250. The gating angle of the thyristors in relationship to the AC supply voltage determines how much rectified voltage is available. Converted DC voltage ($V_{DC}$) is equal to 1.35 times the RMS value of input voltage ($V_{RMS}$) times the cosine of the phase angle (cos $\alpha$): $V_{DC}=1.35\times V_{RMS}\times\cos\alpha$. The value of the DC voltage that can be obtained from a 460V AC input is thus −621V DC to +621V DC. The addition of the second, negative bridge 251 (i.e. connected in reverse with respect to the first positive bridge 250) in the circuit allows for four-quadrant operation. The positive bridge 250 charges the lifting magnet 113 during the "Lift" mode and returns energy from the lifting magnet 113 back to the AC input during discharge. This four-quadrant circuit can also be used to demagnetize the lifting magnet 113 by applying voltage in the opposite polarity by using the negative bridge 251 as the bridge used to bring voltage to the lifting magnet 113 and returning energy to the AC input (for example, at the end of "Drop"). The time during which the negative bridge 251 restores energy from the magnet back to the AC input is called the secondary discharge. Those skilled in the art will recognize that the polarity of the lifting magnet 113 is reversible, such that the positive bridge 250 can be used to demagnetize the lifting magnet 113 during the "Drop" mode and the negative bridge 251 can be used to magnetize the lifting magnet 113 during the "Lift" mode; the previous directions have been described for convenience. It will also be apparent to one skilled in the art that the use of three-phase power is not necessary for all cycles.

The thyristors 101-112 act as transient protection devices themselves, and prevent failures in the DC Regulated Power Supply 400 or in the AC input power from damaging components in the DC Regulated Power Supply 400 by conducting before the output voltage of the supply rises above the breakover voltage of the thyristors by freewheeling the magnet coil. The thyristors 101-112 are usually chosen so that their breakover voltage is higher than the greatest voltage expected to be experienced from the power source, so that they can be turned on by intentional voltage pulses applied to the gates. If other types of switches are used, those skilled in the art will recognize that transient protection devices can be added to protect against voltage spikes.

Figure 3:
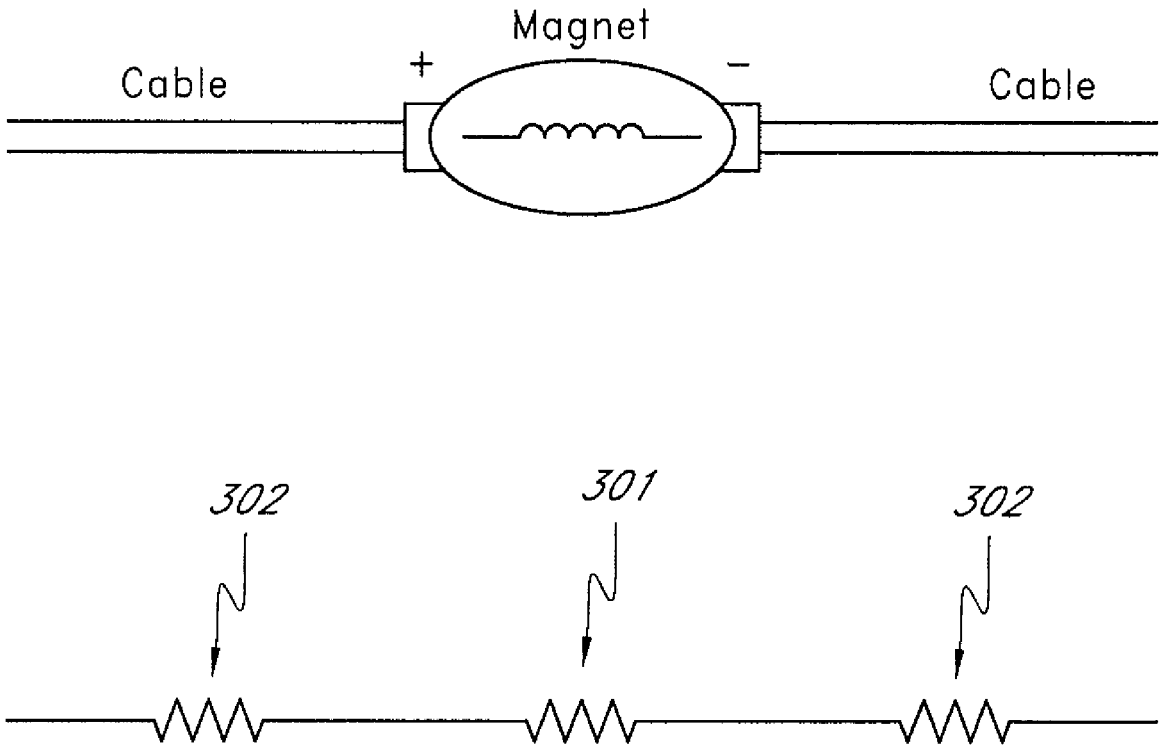
FIG. 3 illustrates an equivalent circuit for magnet resistance calculation.

FIG. 3 shows the actual and equivalent circuits used for magnet resistance calculation. Overheating of the lifting magnet 113 can lead to melting or short-circuits, and a need to rewind the lifting magnet 113. The internal temperature of the lifting magnet 113 can be measured by a thermistor or other temperature sensor, if such a device was embedded in the lifting magnet 113 during the process of magnet winding. In one embodiment, the temperature of the lifting magnet 113 is calculated by measuring the electrical resistance 301 of the magnet 113 because the resistance 301 of the lifting magnet 113 is substantially proportional to the temperature of the lifting magnet 113. The magnet resistance 301 is calculated based on readings of voltage and current across the lifting magnet 113 or across the load side of the DC Regulated Power Supply 400 and by taking into account the resistance 302 of the cables. The resistance 302 of the cables can either be (1) calibrated out, (2) measured and subsequently subtracted from the total resistance reading, or (3) disregarded if the resistance 302 is assumed to be small in relation to the magnet resistance 301. The cables are not expected to get hot because of the low value of their resistance 302 and their exposure to air. However, the lifting magnet 113 gets hot because of the relatively high density of windings in relation to the surface area available for cooling (typically, cooling is achieved by natural convection). Lifting magnets are generally designed for a resistance increase of about 50% when they get hot. The formula to calculate the magnet resistance 301 at a given temperature is: $R_H=R_0\ (1+K\ \Delta\theta)$, where $R_0$=cold resistance of the lifting magnet 113, in Ω, K=temperature coefficient of the magnet 113 (typically 0.004Ω/° C. for a copper- or aluminum-wound magnet), and $\Delta\theta$=change in temperature, in ° C.

The lifting magnet's calculated resistance 301 is compared to two parameters: the "Alarm resistance" and the "Trip resistance". The "Alarm resistance" is a threshold value which, if exceeded, triggers the system to provide an alarm to warn the operator to either turn off the lifting magnet 113 or to indicate that the system is picking up materials which are too hot, or that the cable is partially cut, or that a connection is loose. The "Trip resistance" is a threshold value which, if exceeded, triggers the system to protect the lifting magnet 113 from overheating. When the trip resistance is exceeded, the system activates a trip relay. If the trip relay is activated when the system is in "Hold" mode, the system will continue through the normal modes of operation of "Hold" and "Drop". However, if the Trip relay is activate when the operator requests a "Lift", the system will not enter into "Lift" mode and instead go directly to "Hold" mode.

Figure 4A:
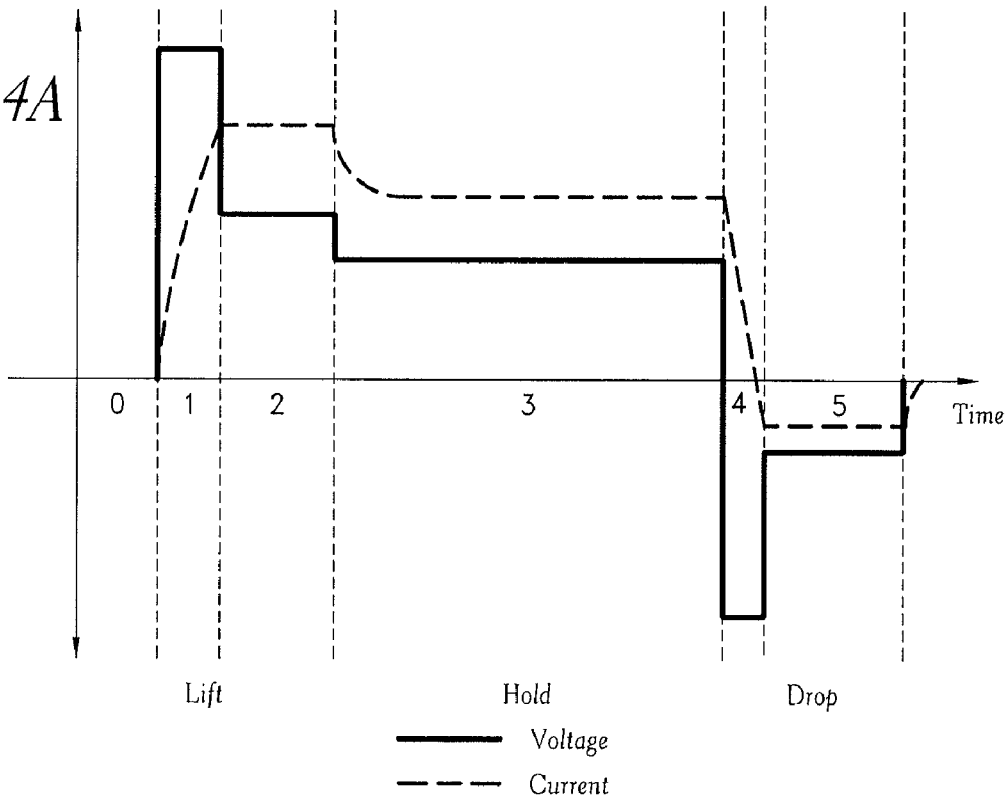
FIG. 4A shows voltage and current signals as the AC magnet controller is operated through "Lift", "Hold" and "Drop" modes for handling scrap material, for example.

FIG. 4A shows voltage and current during the "Lift", "Hold" and "Drop" modes for applications such as scrap material handling. The "Lift" mode is initiated by the operator. During the "Lift" mode, the positive bridge 250 applies a high voltage level across the lifting magnet 113 until the current reaches the limiting current for the lifting magnet 113 through the positive bridge 250. The "Lift" mode lasts long enough to charge the lifting magnet 113 yet is short enough to prevent overheating of the lifting magnet 113. The length of time for the "Lift" mode will vary based on the time constant of the lifting magnet 113, the desired current for the lifting magnet 113 and the voltage applied to the lifting magnet 113. During the charge, the first portion of the "Lift" mode, there is a relatively high average voltage applied to the lifting magnet 113 (typically adjusted around 500V for an AC supply of 460V AC) and the current rises relatively fast. Once the current has risen, then the current is limited and held at a plateau for a specified time to allow magnetic field to build up.

The "Hold" mode is initiated automatically after a specified time in "Lift" mode. During the "Hold" mode, the positive bridge 250 applies a different (lower) voltage level across the lifting magnet 113, for as long as the operator needs in order to move the load. The "Hold" voltage is set below the lifting magnet 113 rated voltage, and the lifting magnet 113 is thus expected to cool down somewhat during the "Hold" mode. In other words, for safety reasons, an energized lifting magnet 113, possibly carrying an overhead load, is not made to automatically shut down. Because of the reduced voltage level, in "Hold" mode, the current decreases to a second lower plateau. Under normal conditions, in the "Hold" mode, the load has already been attracted, air gaps are at a relatively low level, and therefore, less magnetic flux is required to keep the load attached. Therefore, the current and the magnetic field across the lifting magnet 113 can be reduced. At the end of the "Hold" mode, the firing angle of the thyristors phases back and energy from the lifting magnet 113 is returned to the AC input until current reaches zero.

The "Drop" mode is initiated by the operator and causes the "Lift" or "Hold" mode to terminate. During the "Drop" mode, the positive bridge 250 thyristors' firing pulses get delayed to cause the polarity of voltage across the lifting magnet 113 to reverse. After the current from the "Drop" mode or the "Hold" mode reaches zero, the negative bridge 251 applies a voltage of reverse polarity across the lifting magnet 113, i.e. reverses the sense of voltage signal until the current reaches the current limit for the lifting magnet 113 through the negative bridge 251. The "Drop" mode expires after yet another specified time. During the "Drop" mode, the current value is specified such as to produce a magnetic field in the lifting magnet 113 that is of the same magnitude but in an opposite direction of the residual magnetic field across the lifting magnet 113, such that the two fields cancel each other. When the lifting magnet 113 is free of residual magnetic field, the load detaches freely from the lifting magnet 113.

In FIG. 4A, during phase 0, the lifting magnet 113 is idle. Phase 1 represents the "Lift" mode during voltage regulation, where the voltage can be adjusted to a relatively high value in order to magnetize the lifting magnet 113 relatively quickly. Phase 2 represents the "Lift" mode during current limiting, where the current limit can be adjusted close to the cold current rating for the lifting magnet 113. Phase 3 represents the "Hold" mode, during which the current is adjusted to be a portion of the cold current such that the lifting magnet 113 does not warm up, while still holding the load; the magnitude of the current during the "Hold" mode can be adjusted such as to compensate for the amount of magnetic hysteresis. Phase 4 represents the "Drop" mode during transient, where the current is adjusted to compensate for the magnetic hysteresis. Phase 5 represents the "Drop" mode, where both current and voltage are held constant, in order to match the magnetic time constant of the lifting magnet 113.

Figure 4B:
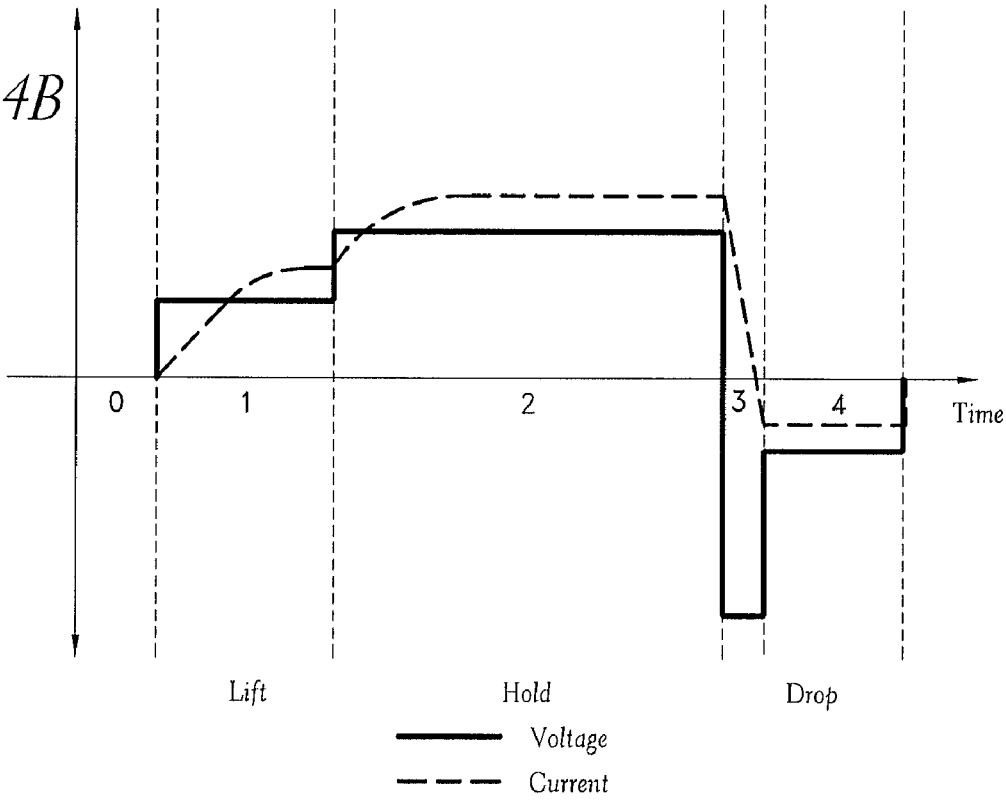
FIG. 4B shows voltage and current signals as the AC magnet controller is operated through "Lift", "Hold" and "Drop" modes for handling plates or slabs, for example.

FIG. 4B shows voltage and current during the "Lift", "Hold" and "Drop" modes for applications such as handling of slab or plates material. The "Lift" mode is initiated by the operator. During the "Lift" mode, the positive bridge 250 applies a preset voltage level across the lifting magnet 113. The length of time for the "Lift" mode will vary based on the time constant of the lifting magnet 113. During the charge, the slab or plates attach to the lifting magnet 113. After the charge, the operator starts to hoist the lifting magnet 113 for a few feet. If the operator wishes to hoist the load further, then the operator can apply a relatively higher voltage to the lifting magnet 113 during the "Hold" mode in order to maintain the load attached to the lifting magnet 113. The "Drop" mode operates the same for this slab or plates' material application as it does for the scrap materials handling application.

In FIG. 4B, during phase 0, the lifting magnet 113 is idle. Phase 1 represents the "Lift" mode where a preset voltage is applied to the lifting magnet 113. Phase 2 represents the "Hold" mode, during which the operator selects a relatively higher voltage to apply across the lifting magnet 113. Phase 4 represents the "Drop" mode during transient, where the current is adjusted to compensate for the magnetic hysteresis. Phase 5 represents the "Drop" mode, where both current and voltage are held relatively constant, in order to match the magnetic time constant of the lifting magnet 113.

In addition to the above three modes, there is a "Sweep" mode, which is optionally activated by the operator. The "Sweep" mode is for applications where the rail car or container to be unloaded has its bottom or walls formed of magnetic material. When unloading is almost complete, to prevent the lifting magnet 113 from sticking to the bottom or walls of the rail car or container, a "Sweep" switch can be activated by the operator to reduce the "Lift" and "Hold" voltages. The reduced voltage across the lifting magnet 113 prevents the magnetized load from attaching to the bottom or walls of the rail car or container while the lifting magnet 113 is unloading.

In one embodiment, the "Lift", "Hold", "Drop" and "Sweep" modes of the magnet controller circuit described above, used to control the lifting magnet 113, can be controlled through the use of the Logic Controller (LC) 100.

The logical programming of the LC 100 is represented in sequential function charts (SFC). SFC is a graphical programming language used for logical controllers, defined in IEC 848. SFC can be used to program processes that can be split into steps.

Figure 5:
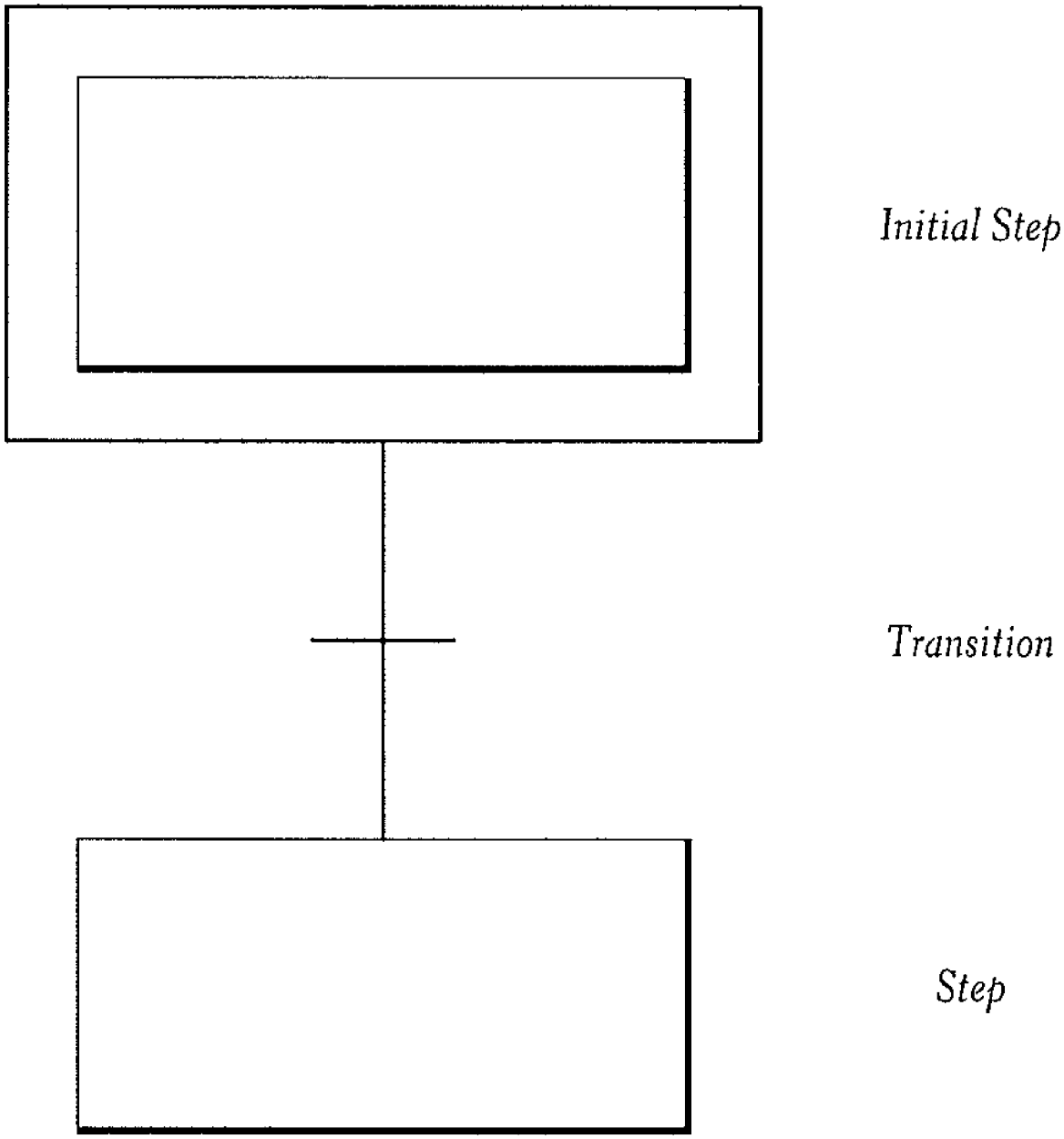
FIG. 5 shows a general Sequential Function Chart (SFC).

FIG. 5 shows a general SFC. Main components of SFC are: steps with associated actions, transitions with an associated logic condition or associated logic conditions, and directed links between steps and transitions. Steps can be active or inactive. Actions are executed for active steps. A step can be active for one of two motives: (1) the step is an initial step as specified by the programmer, (2) the step was activated during a scan cycle and was not deactivated since. A step is activated when the steps above that step are active and the connecting transition's associated condition is true. When a transition is passed, the steps above the transition are deactivated at once and the steps below the transition are activated at once.

An SFC program has three parts: (1) preprocessing, which includes power returns, faults, changes of operating mode, pre-positioning of SFC steps, input logic; (2) sequential processing, which includes steps, actions associated with steps, transitions and transition conditions; and (3) post-processing, which includes commands from the sequential processing for controlling the outputs and safety interlocks specific to the outputs.

Figure 6:
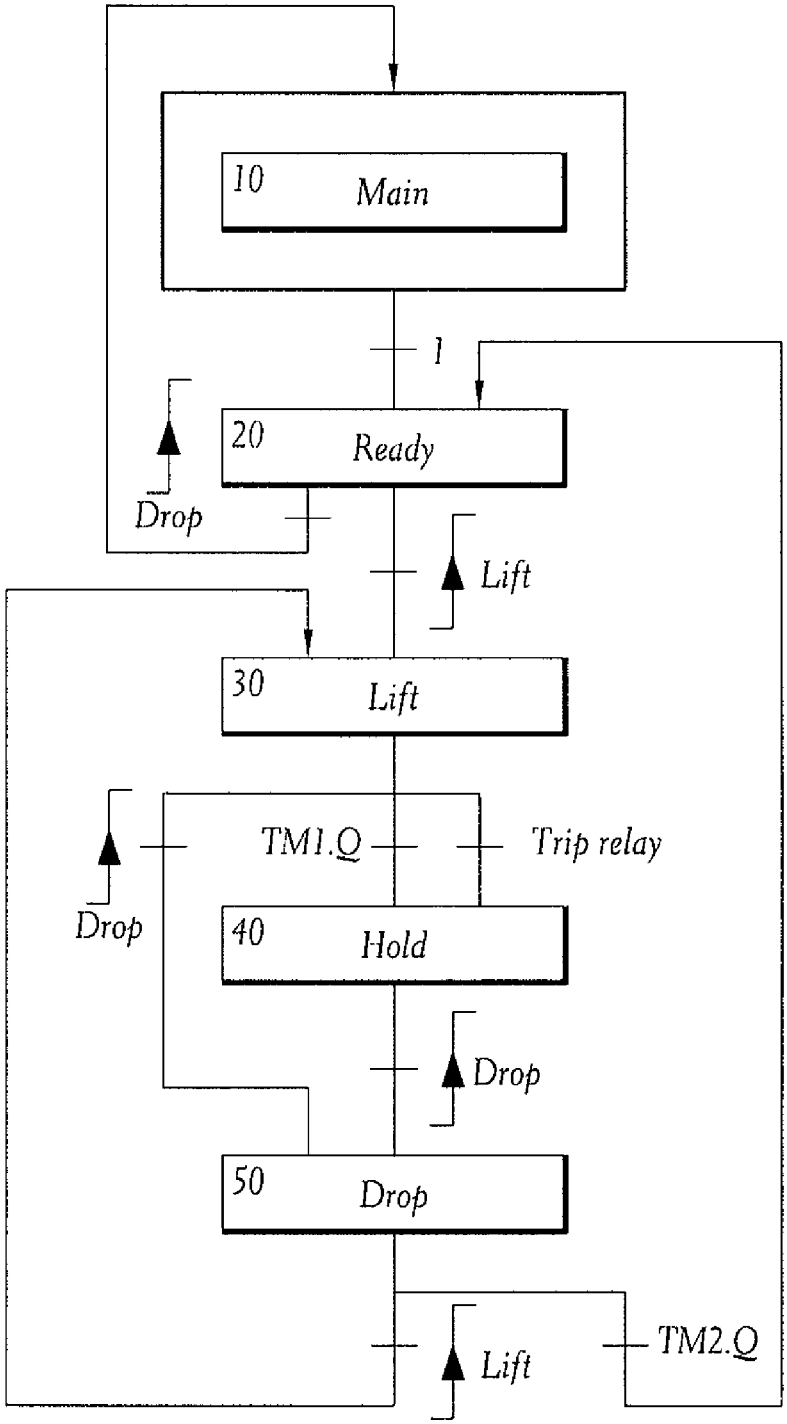
FIG. 6 shows a flowchart for the Main SFC.

FIG. 6 shows a flowchart for the Main SFC. In FIG. 6, step "10 Main" has no associated actions and the transition to step "20 Ready" is true. Step "10 Main" can be accessed either if a "Drop" input is received by the operator while in step "20 Ready" or when the SFC is initialized. Step "20 Ready" is initiated either automatically after step "10 Main" or after a preset time TM2 in step "50 Drop". Step "20 Ready" starts the Ready SFC. From step "20 Ready", a "Drop" command by the operator calls step 10. Step "30 Lift" starts the Lift SFC. "Lift" is initiated by a lift command from steps "20 Ready" or "50 Drop". Step "40 Hold" is initiated either automatically after a preset time TM1 in step "30 Lift", or immediately after a "Lift" input in step "20 Ready" if the magnet temperature trip relay is active. Step "40 Hold" initiates the Hold SFC. Step "50 Drop" is initiated by a "Drop" rising edge from either step "30 Lift" or "40 Hold", and step "50 Drop" initiates the Drop SFC.

Figure 7:
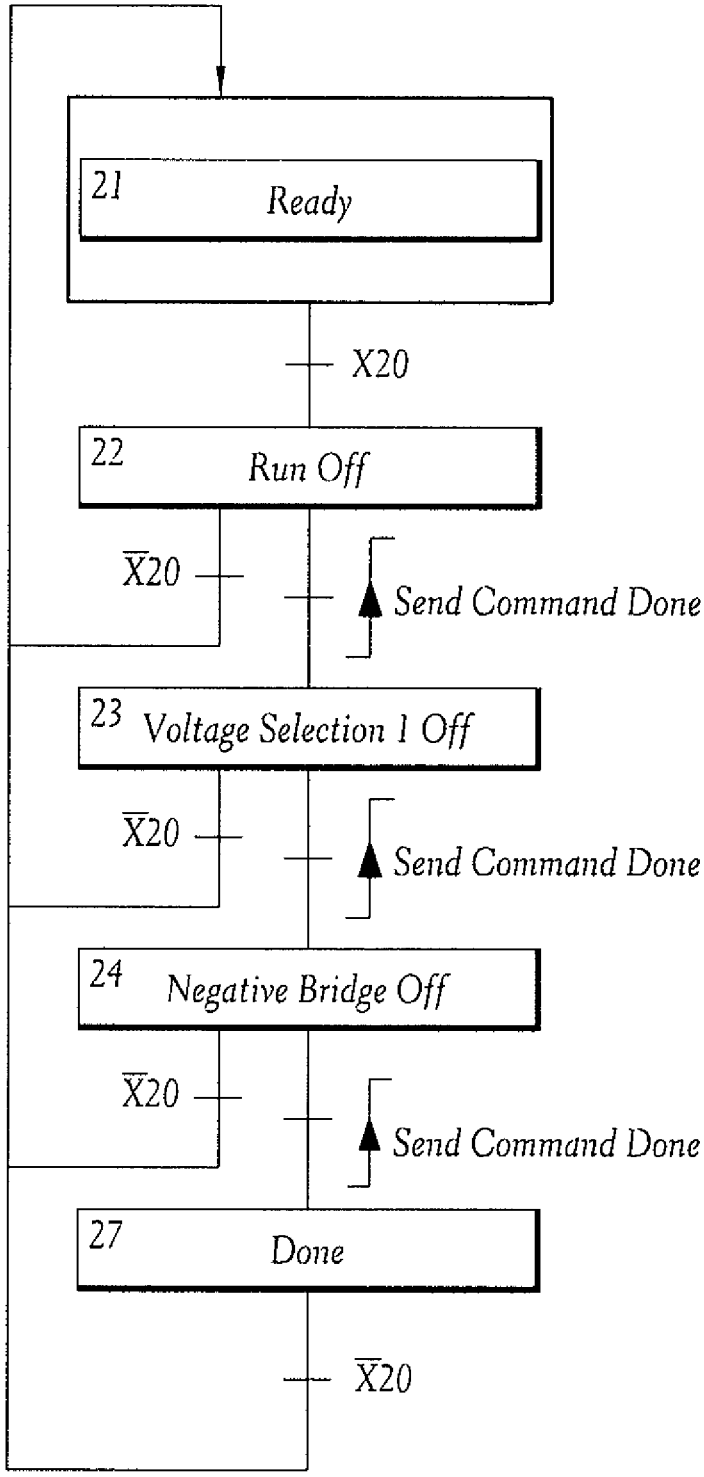
FIG. 7 shows a flowchart for the Ready SFC.

FIG. 7 shows a flow chart for the Ready SFC. Step "21 Ready" is the initialization step. Step "21 Ready" will be active when the Main SFC is not in step "20 Ready". Step "21 Ready" is not associated with any actions. Step "20 Ready"

getting active in the Main SFC causes transition X20 to be true and to make step "22 Run Off" active. Once step "20 Ready" is active, unless step "20 Ready" stops to be active and causes $\overline{X20}$ to be true and the SFC to return to step "21 Ready", the SFC stays in step "22 Run Off". While the SFC is in step "22 Run Off", the LC 100 sends commands to the control circuitry to turn off the current in the magnet 113. From step "22 Run Off", the SFC transitions to step "23 Voltage Selection 1 Off" when the Send Command Done is true, and the SFC transitions from step "23 Voltage Selection 1 Off" to step "24 Negative Bridge Off" when the Send Command Done is true. From step "24 Negative Bridge Off", the SFC transitions to step "27 Done" when the Send Command Done is true.

Figure 8:
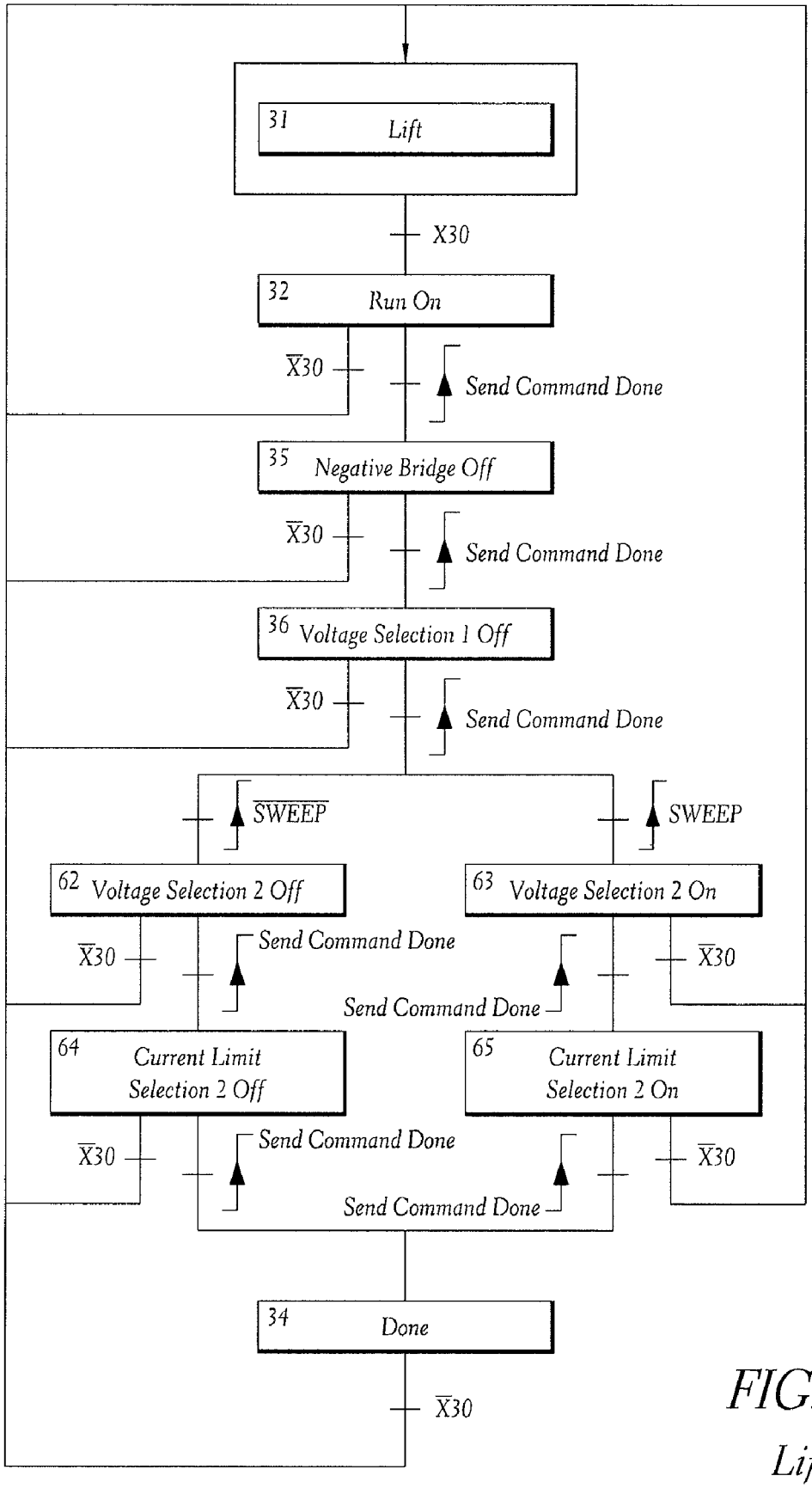
FIG. 8 shows a flowchart for the Lift SFC

FIG. 8 shows a flowchart for the Lift SFC. The first step to be activated, "32 Run On", is to reduce to a minimum the delay time between the activation of the "Lift" input by the operator and the response by the circuitry. Steps "35 Negative Bridge Off" and "36 Voltage Selection 1 Off" are used if the step before "30 Lift" was "50 Drop" in the Main SFC and the Send Command Done is true. "Sweep" is a switch that can be toggled by the operator. If "Sweep" is on, "Voltage Selection 2" and "Current Limit Selection 2" are on, and the system selects the second set of voltage references and the second current limit. If "Sweep" is off, "Voltage Selection 2" and "Current Limit Selection 2" are off, and the system selects the primary set of voltage references and the primary current limit.

Figure 9:
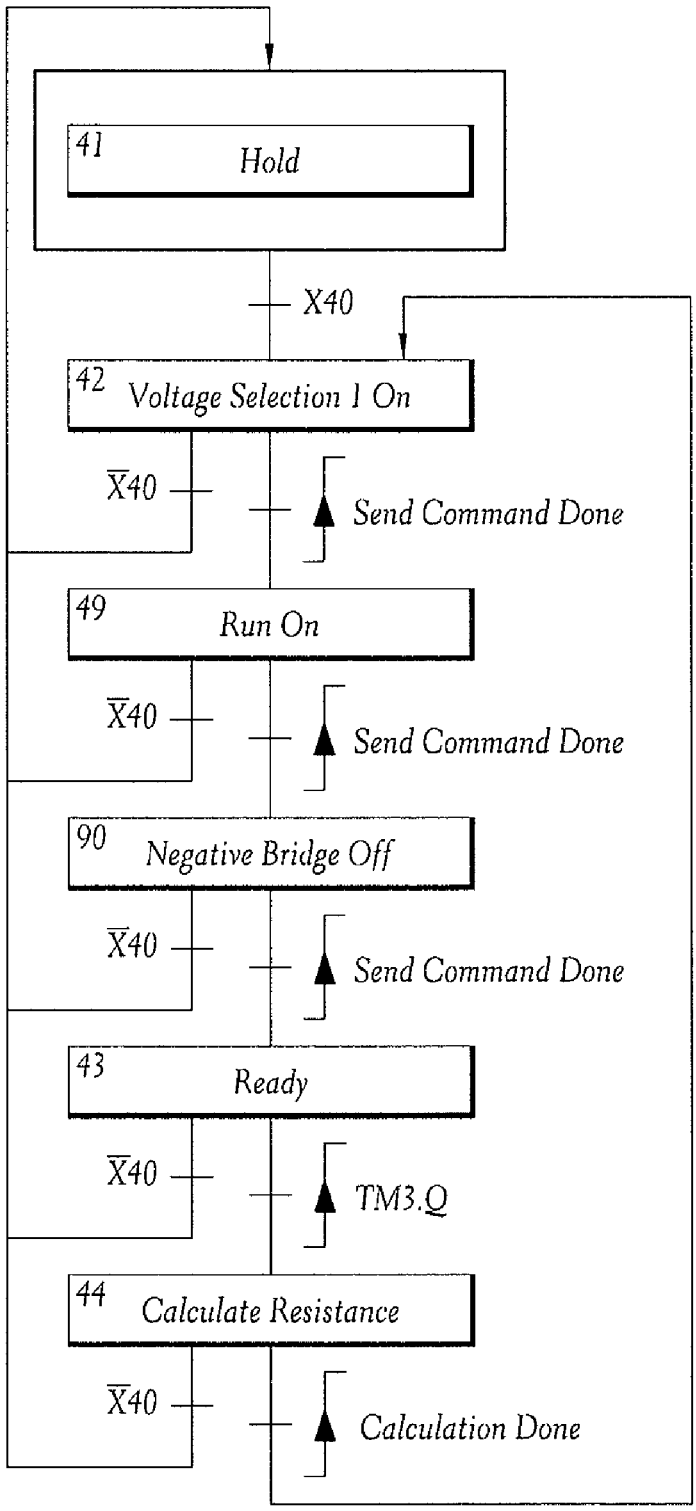
FIG. 9 shows a flowchart for the Hold SFC.

FIG. 9 shows a flow chart for the Hold SFC. Step "41 Hold" is the initialization step. Step "40 Hold" getting active in the Main SFC causes transition X40 to be true and to make step "42 Voltage Selection 1 On" active. Once the step "42 Voltage Selection 1 On" is active, unless step "40 Hold" stops to be active and causes $\overline{X40}$ to be true and the SFC to return to step "41 Hold", the SFC stays in step "42 Voltage Selection 1 On". While the SFC is in step "42 Voltage Selection 1 On", the LC 100 sends commands to control the lifting magnet circuitry.

The SFC transitions from step "42 Voltage Selection 1 On" to step "49 Run On" when Send Command Done is true. The SFC transitions from step "49 Run On" to step "90 Negative Bridge Off" when Send Command Done is true. The SFC transitions from step "90 Negative Bridge Off" to step "43 Ready" when Send Command Done is true. Once the SFC is in step "43 Ready", after the timer TM3 elapses, the voltage and current across the lifting magnet 113 are stabilized and the LC 100 gets updates from the system for readings of Volts across the lifting magnet 113 and Amps going across the lifting magnet 113. Based on those readings, the LC 100 calculates the magnet resistance and determines whether or not the alarm resistance is exceeded, and whether or not the trip resistance is exceeded. Each of these updates is requested after the previous update is done.

Figure 10:
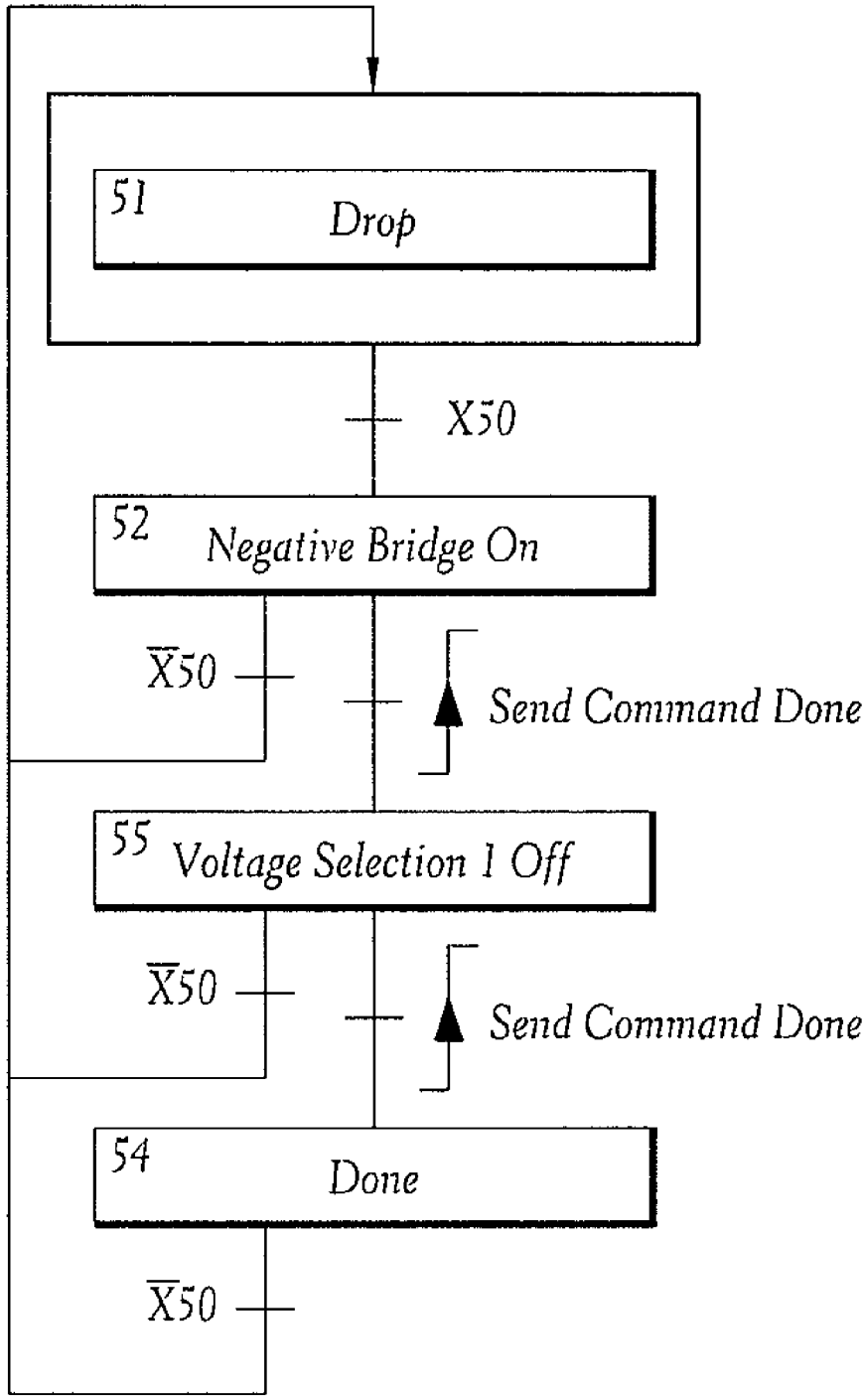
FIG. 10 shows a flowchart for the Drop SFC.

FIG. 10 shows a flow chart for the Drop SFC. Step "50 Drop" getting active in the Main SFC causes transition X50 to be true and to make step "52 Negative Bridge On" active. In step "52 Negative Bridge On", the system selects the negative bridge 251. The current limit for the negative bridge 251 is set at a fraction of the current limit for the positive bridge 250. Then, in step "55 Voltage Selection 1 Off", voltage selection is reset. The system remains in "Drop" mode until the Main SFC exits step "50 Drop" either after timer TM2 expires or when a "Lift" command is requested by the operator.

In one embodiment, the circuitry used to control the lifting magnet 113 can be obtained by appropriately programming a DC Regulated Power Supply 400, normally used to control motors. The LC 100 can be set up with access to the DC Regulated Power Supply 400 logic, allowing the setting of parameters to be changed to suit different operating conditions.

In one embodiment, the Mentor II DC Drive manufactured by Control Techniques of Minnesota, United States (Model M550R?). can be used as the DC Regulated Power Supply.

The thyristors in the DC Regulated Power Supply 400 are fired when the "Run ON" command is sent during step "32 Run On" of the Lift SFC.

During the "Lift" mode, the positive bridge 250 applies the voltage from the DC Regulated Power Supply 400, usually set around 500V DC across a 240V DC rated lifting magnet 113 to boost the charge until the current gets limited by the limiting current for the lifting magnet 113. In addition, the "Lift" time is controlled by the value in timer TM1 of the LC 100.

During the "Hold" mode, the positive bridge 250 applies a voltage of around 180 V DC across a 240 V DC rated magnet 113. This holding voltage is adjustable and set in the LC 100. In addition, after being in "Hold" mode for about 5 seconds, as preset in timer TM3 of the LC 100, and periodically at each period of time preset in timer TM3, the LC 100 reads the current and voltage across the DC Regulated Power Supply 400.

Figure 11:
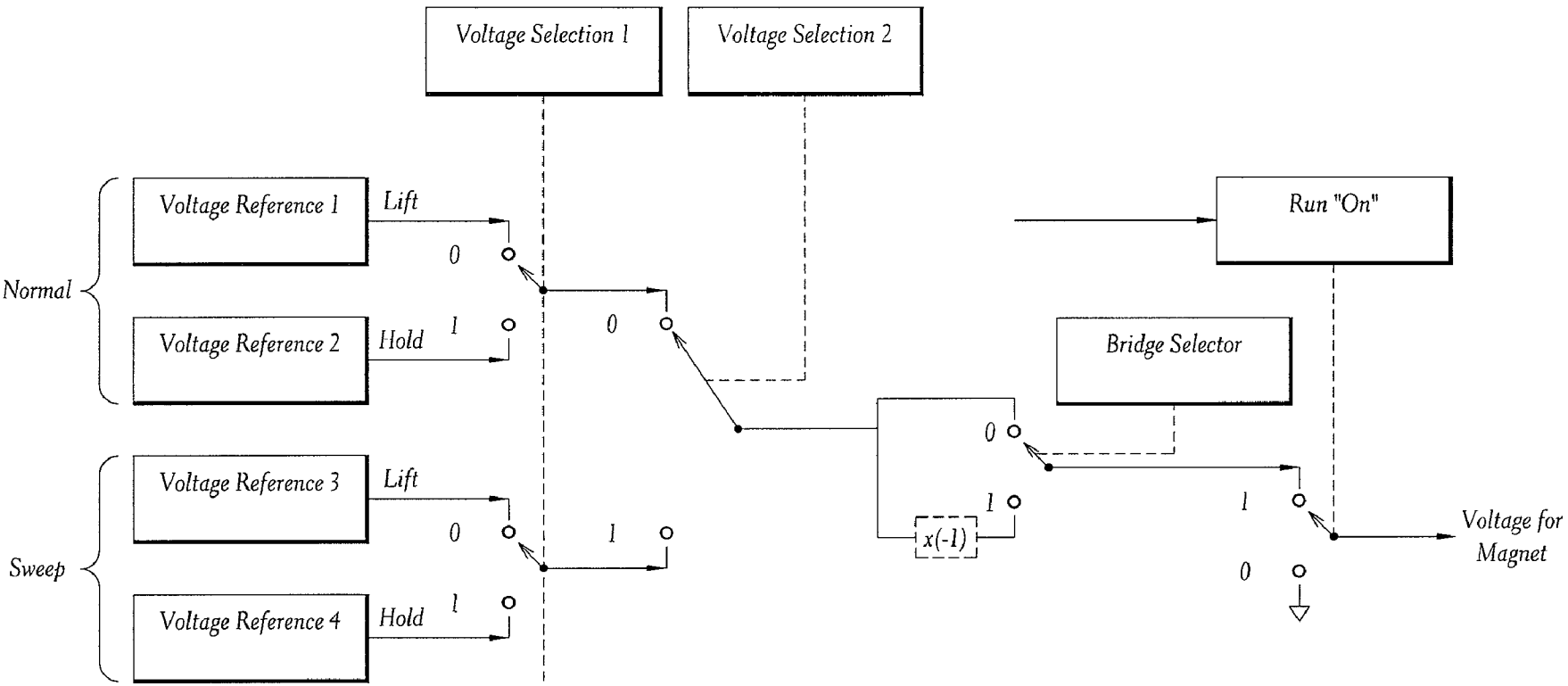
FIG. 11 shows one embodiment of the DC Regulated Power Supply Voltage Selection.

During the "Drop" mode, the negative bridge 251 is turned on by changing the value in parameter "Bridge Selector", shown in FIG. 11. During the "Drop" mode, the current can be limited by the parameter "Current Limit for Negative Bridge" shown in FIG. 12. In addition, the time for the "Drop" mode is preset by parameter TM2.

Figure 12:
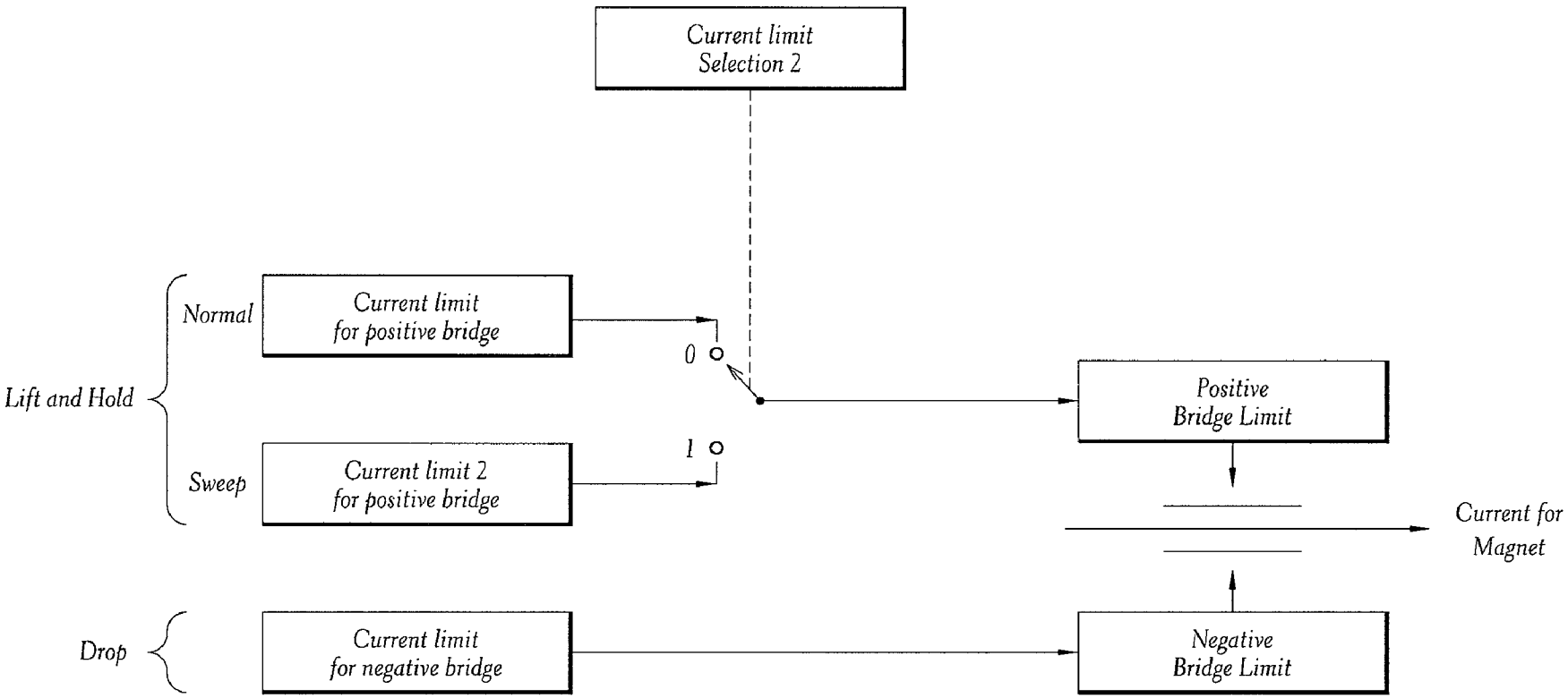
FIG. 12 shows one embodiment of the DC Regulated Power Supply Current Selection.

During the "Sweep" mode, depending on whether a "Sweep" command is received by the operator at the LC 100, "Voltage Selection 2" is set to on or off in the DC Regulated Power Supply 400. If "Sweep" is off, "Voltage Selection 2" is off, as shown in FIG. 11. Therefore, the reference voltages in "Voltage Reference 1" and "Voltage Reference 2" of the DC Regulated Power Supply 400 are respectively selected during "Lift" and "Drop", depending on the value of "Voltage Selection 1". On the other hand, if "Sweep" is on, "Voltage Selection 2" is enabled. By enabling "Voltage Selection 2", the "Voltage Reference 3" and "Voltage Reference 4" of the DC Regulated Power Supply 400 are respectively selected during "Lift" and "Drop", again, depending on the value of "Voltage Selection 1". Furthermore, during the "Sweep" mode, the current is limited by parameter "Current Limit 2", as shown in FIG. 12.

It will be apparent to those skilled in the art how the "Lift" and "Hold" modes described above function when the system is used in a slab or plates material handling application, and the voltage levels are adjusted accordingly.

The temperature protection for the lifting magnet 113 is controlled through the use of parameters "Alarm Resistance" and "Trip Resistance". The resistance value at which the system activates an alarm relay during the "Hold" mode is set into parameter "Alarm Resistance", based on the lifting magnet 113 manufacturer's rated hot current. The resistance value at which the system activates a trip relay is set into parameter "Trip Resistance", based on the insulation class temperature of the lifting magnet 113. When the resistance 301 of the lifting magnet 113 exceeds the value set in parameter "Trip Resistance", the next cycle begins directly in "Hold" mode. When the lifting magnet 113 cools down and its resistance value 301 becomes less than the value set in parameter "Trip Resistance", then the system enters "Lift" mode again. Cable ohmic resistance 302 of the wiring between the lifting magnet 113 and the LC 100 is set in parameter "Wiring Resistance".

To calculate the magnet resistance, the LC 100 divides the voltage by the current and then subtracts the value set in "Wiring resistance".

In addition to the above parameter settings, some parameters in selected DC Regulated Power Supplies can be adjusted to accommodate for highly inductive loads like the lifting magnet 113. Generally, voltage loop and current loop PID gain circuitries need to be optimized, current feedback resistors scaled to accommodate for the inductance of the magnet 113, and a safety margin of 1 supply cycle added to the bridge changeover logic to prevent shorting the line by having a thyristor in one bridge firing while another thyristor in the other bridge were still conducting.

It will be evident to those skilled in the art that the invention is not limited to the details of the foregoing illustrated embodiments and that the present invention may be embodied in other specific forms without departing from the spirit or essential attributed thereof, furthermore, various omissions, substitutions and changes may be made without departing from the spirit of the inventions. The foregoing description of the embodiments is, therefore, to be considered in all respects as illustrative and not restrictive, with the scope of the invention being delineated by the appended claims and their equivalents.

What is claimed is:

1. A lifting magnet system, comprising:

a three-phase AC power source;

a positive bridge circuit comprising six thyristors, wherein a first pair of thyristors are arranged in series with a first phase of said three-phase AC power source, a second pair of thyristors are arranged in series with a second phase of said three-phase AC power source, and a third pair of thyristors are arranged in series with a third phase of said three-phase AC power source wherein during lift, said positive bridge circuit is configured to generate a first voltage, and during hold, said positive bridge circuit is configured to generate a second voltage less than said first voltage, in a sweep mode, said positive bridge circuit is configured to generate a third voltage during sweep lift that is less than said first voltage and a fourth voltage during sweep hold that is less than said second voltage;

a negative bridge circuit comprising six thyristors, wherein a fourth pair of thyristors are arranged in series with said first phase of said three-phase AC power source, a fifth pair of thyristors are arranged in series with said second phase of said three-phase AC power source, and a sixth pair of thyristors are arranged in series with a third phase of said three-phase AC power source, wherein said first pair of thyristors of said positive bridge circuit are arranged in parallel with said fourth pair of thyristors of said negative bridge circuit, said second pair of thyristors of said positive bridge circuit are arranged in parallel with said fifth pair of thyristors of said negative bridge circuit, and said third pair of thyristors of said positive bridge circuit are arranged in parallel with said sixth pair of thyristors of said negative bridge circuit;

an electromagnet; and a logic controller controlling said positive bridge circuit and said negative bridge circuit, during lift said logic controller controlling the thyristors in the positive bridge circuit in repeating sequence to output substantially direct current to the electromagnet and to apply said first voltage to the electromagnet to charge the electromagnet, during hold said logic controller controlling the thyristors in the positive bridge circuit in repeating sequence to output substantially direct current to the electromagnet and to apply said second voltage to the electromagnet that is less than the first voltage applied during lift in order to prevent damage to the electromagnet, during sweep lift said logic controller controlling said thyristors in said positive bridge circuit in repeating sequence to apply said third voltage to said electromagnet that is less than said first voltage, during sweep hold said logic controller further controlling said thyristors to apply a fourth voltage to said electromagnet that is less than said second voltage, during drop said logic controller controlling the thyristors in the negative bridge circuit in repeating sequence to output substantially direct current to the electromagnet and to apply a voltage to the electromagnet that is the reverse of the voltage applied during lift to demagnetize the electromagnet.

2. The lifting magnet system of claim 1, wherein said thyristors prevent damage to themselves by automatically conducting before the voltage across the electromagnet rises above the breakover voltage of said thyristors.

3. The lifting magnet system of claim 1, wherein the breakover voltage of said thyristors is higher than the greatest voltage expected to be experienced from the power source.

4. A control system for a lifting magnet, comprising:

a first bridge comprising a plurality of switches arranged in serial pairs wherein during lift, said first bridge is configured to generate a first voltage, and during hold, said first bridge is configured to generate a second voltage less than said first voltage, in a sweep mode, said first bridge circuit is configured to generate a third voltage during sweep lift that is less than said first voltage and a fourth voltage during sweep hold that is less than said second voltage;

a second bridge comprising a plurality of switches arranged in serial pairs;

wherein at least one serial pair of switches of said first bridge are arranged in parallel with at least one serial pair of switches of said second bridge; and a logic controller controlling said first bridge and said second bridge, during lift said logic controller controlling the switches in the first bridge in repeating sequence to output substantially direct current to the lifting magnet and to apply a the first voltage to the lifting magnet to charge the lifting magnet, during hold said logic controller controlling the switches in the first bridge in repeating sequence to output substantially direct current to the lifting magnet and to apply the second voltage to the lifting magnet less than the voltage applied during lift to prevent damage to the lifting magnet, during sweep lift, said logic controller controlling said thyristors in said first bridge in repeating sequence to apply said third voltage to said lifting magnet that is less than said first voltage, during sweep hold, said logic controller further controlling said thyristors to apply a fourth voltage to said lifting magnet that is less than said second voltage, during drop said logic controller controlling the switches in the second bridge in repeating sequence to output substantially direct current to the lifting magnet and to apply a voltage to the lifting magnet that is the reverse of the voltage applied during lift to demagnetize the lifting magnet.

5. The control system of claim 4, wherein said switches comprise thyristors.

6. The control system of claim 4, wherein said switches are turned on before the voltage across the lifting magnet rises above the drain-source voltage of said switches.

7. The control system of claim 4 where the voltage applied during lift is different than the voltage applied during hold.

8. The control system of claim 4 where the voltage applied during lift is greater than the voltage applied during hold.

9. The control system of claim 4 where the voltage applied during lift is less than the voltage applied during hold.

10. The control system of claim 4 where the voltage applied during lift is at least twice the voltage applied during hold.

11. The control system of claim 4 where the voltage applied during lift and the voltage applied during hold are user-selectable.

* * * * *